PM032 XR 4,246,705

United States Patent [19]

Lee

[11] 4,246,705

[45] Jan. 27, 1981

[54] ALIGNMENT OF WEAPON TRAINING SYSTEMS

[75] Inventor: Derek J. Lee, Farnborough, England

[73] Assignee: The Solartron Electronic Group Limited, Farnborough, England

[21] Appl. No.: 74,208

[22] Filed: Sep. 10, 1979

[30] Foreign Application Priority Data

Sep. 13, 1978 [GB] United Kingdom ..... 36658/78

[51] Int. Cl.[3] ..... F41G 3/26

[52] U.S. Cl. ..... 434/22

[58] Field of Search ..... 35/25; 273/310; 235/404, 405, 407, 411, 412, 413, 414, 415, 416, 417; 364/423, 516, 517, 801

[56] References Cited

U.S. PATENT DOCUMENTS

| | | | |
|---|---|---|---|
| 3,143,811 | 8/1964 | Tucci et al. | 35/25 |
| 3,243,896 | 4/1966 | Immarco et al. | 35/25 |
| 3,588,108 | 6/1971 | Ormiston | 35/25 X |
| 3,877,157 | 4/1975 | Ashford et al. | 35/25 |
| 3,882,496 | 5/1975 | Lewis et al. | 35/25 X |

FOREIGN PATENT DOCUMENTS

| | | | |
|---|---|---|---|
| 2153895 | 5/1973 | Fed. Rep. of Germany | 35/25 |
| 1115141 | 5/1968 | United Kingdom | 35/25 |
| 1228143 | 4/1971 | United Kingdom | 35/25 |
| 1228144 | 4/1971 | United Kingdom | 35/25 |
| 1298332 | 4/1971 | United Kingdom | 35/25 |
| 1451192 | 9/1976 | United Kingdom | 35/25 |

*Primary Examiner*—William H. Grieb

*Attorney, Agent, or Firm*—Joseph J. Kaliko; Mikio Ishimaru; Dale V. Gaudier

[57] ABSTRACT

For initial alignment of a simulator laser-projector with a weapon, the weapon is boresighted on a target, the projector is fitted and the laser beam is scanned stepwise across the target successively along orthogonal axes. The range of steps on each axis for which a return from the target occurs is sensed, and the step corresponding to the median of all the returns taken as the position for which the laser beam is centered on the target. These calculated positions are stored and used as the reference positions during simulated firing of the weapon. The detection of the position of a target for hit/miss determination is achieved with the same scanning and median selection procedure.

9 Claims, 10 Drawing Figures

FIG. 6
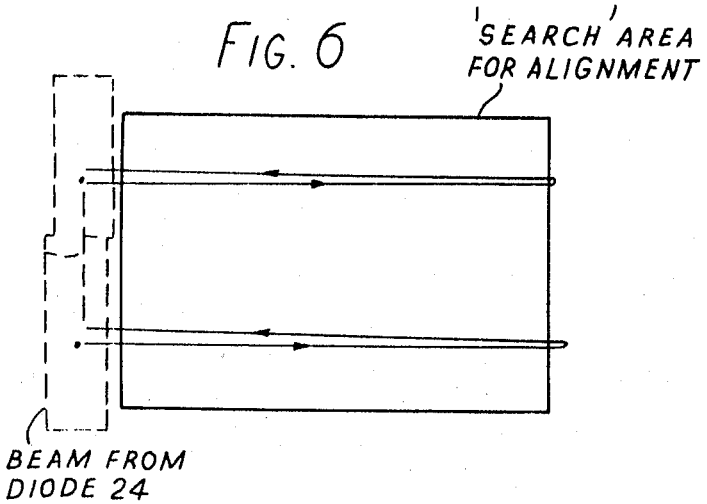
FIG. 7
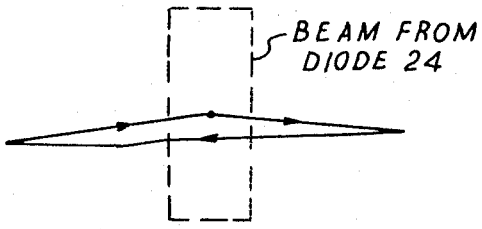
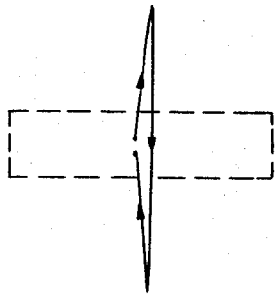
FIG. 8

ALIGNMENT OF WEAPON TRAINING SYSTEMS

This invention relates to alignment of weapon training systems with, for example, the bore of a weapon such as a gun with which the system is associated.

Weapon training systems for training weapon operators in aiming and firing procedures without the expense and danger of firing live ammunition are well known, and are described in our British Patent Specifications Nos. 1,228,143, 1,228,144 and 1,451,192. In these systems, a weapon is typically sighted on a target, and a source of electromagnetic radiation, such as a laser, contained in the training system and aligned with the weapon, is used to determine the range of the target. Thereafter, the weapon is aimed by offsetting it in elevation and azimuth, to take account of the range (and motion, if any) of the target. When the weapon is 'fired', the laser beam is offset in the opposite sense by the correct amounts for a target having the measured range and motion, so that, if the weapon has been correctly aimed, the offsets applied to the weapon are exactly compensated and the ultimate orientation of the laser beam (the beam datum direction) corresponds to the direction to the target. Energisation of the laser can then be detected at the target to indicate a 'hit'.

It is evident that the system must be able to bring the orientation of the laser beam accurately into line with the weapon (that is, for example, with the main bore-sight of a tank gun) every time the above procedure is commenced. Therefore, in known systems it has been the practice to align a system by adjusting the laser mounting on the weapon, with the beam in a predetermined orientation relative to the mounting, until the beam is oriented in the required direction relative to the weapon.

According to a first aspect of this invention there is provided a method for the alignment of weapon training systems comprising the steps of sighting a weapon, having associated therewith source means for providing a beam of electromagnetic radiation at means for enabling incidence of a beam thereupon to be detected, scanning said source means through a plurality of beam orientations relative to said weapon, energising said source means for each orientation and storing an indication of each orientation in which incidence of the beam is detected, and deriving from said indications the beam orientation in which the system is aligned with the weapon.

During subsequent operation of the system, the source means is merely moved to the beam orientation derived in the last step mentioned above whenever the beam is required to be in line with the weapon.

In the case of a gun, the step of sighting the weapon would preferably involve bore-sighting the gun.

Preferably said source means is energised a plurality of times for each said beam orientation, and the number of times incidence of the beam is detected for each said beam orientation is stored. The beam orientation in which the system is aligned with the weapon may then be selected as the one for which substantially equal numbers of indications of incidence of the beam exist for orientations each side of the selected orientation.

According to a second aspect of this invention there is provided a weapon training system, comprising source means associated with a weapon for providing a beam of electromagnetic radiation, means for enabling incidence of the beam thereupon to be detected, means for scanning the source means through a plurality of beam orientations relative to the weapon when the weapon has been sighted on the detection-enabling means, means for energising the source means for each said orientation, means for storing an indication of each orientation in which incidence of the beam is detected, and means for deriving from said indications the beam orientation in which the system is aligned with the weapon.

The energising means may be arranged to energise the source means a plurality of times for each said beam orientation, the storing means then storing the number of times incidence of the beam is detected for each said beam orientation; the deriving means would then be arranged to select the beam orientation for which substantially equal numbers of indications of incidence of the beam exist for orientations each side of the selected orientation.

This technique of energising the source means more than once at each of a plurality of beam orientations, and selecting the "median" beam orientation, is also of value during normal use of the weapon training system, when the beam is scanned to provide information concerning the direction of the target in relation to the beam datum direction. Furthermore, it is envisaged that the technique may also be of use in circumstances where it is desired to detect the presence and direction of a beam of remotely-generated electromagnetic radiation.

A method and apparatus in accordance with this invention will now be described, by way of example, with reference to the accompanying drawings, in which.

Figure 4:
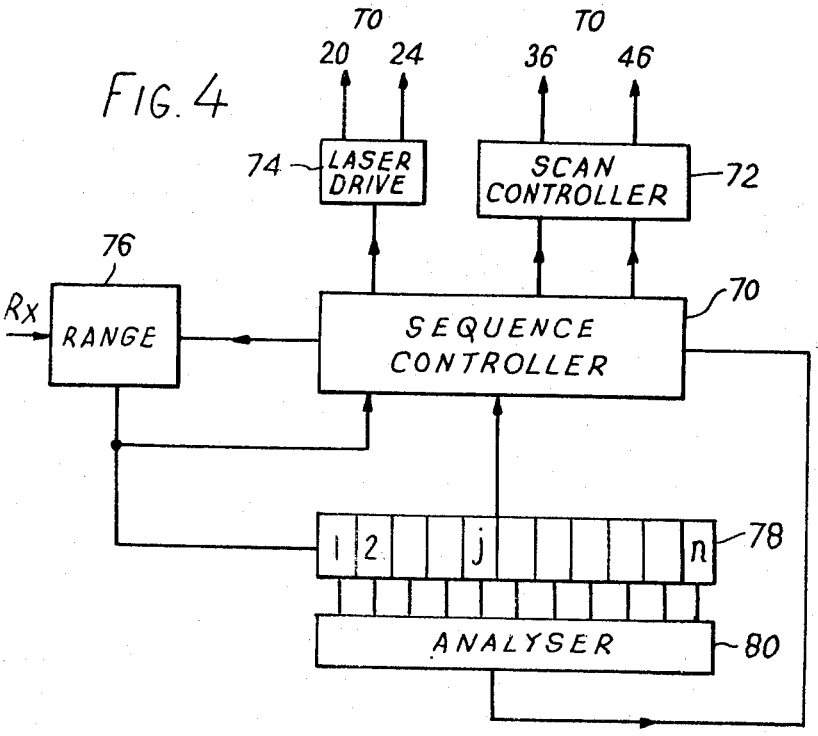
FIG. 4 is a schematic diagram of the apparatus.
Figure 5A:
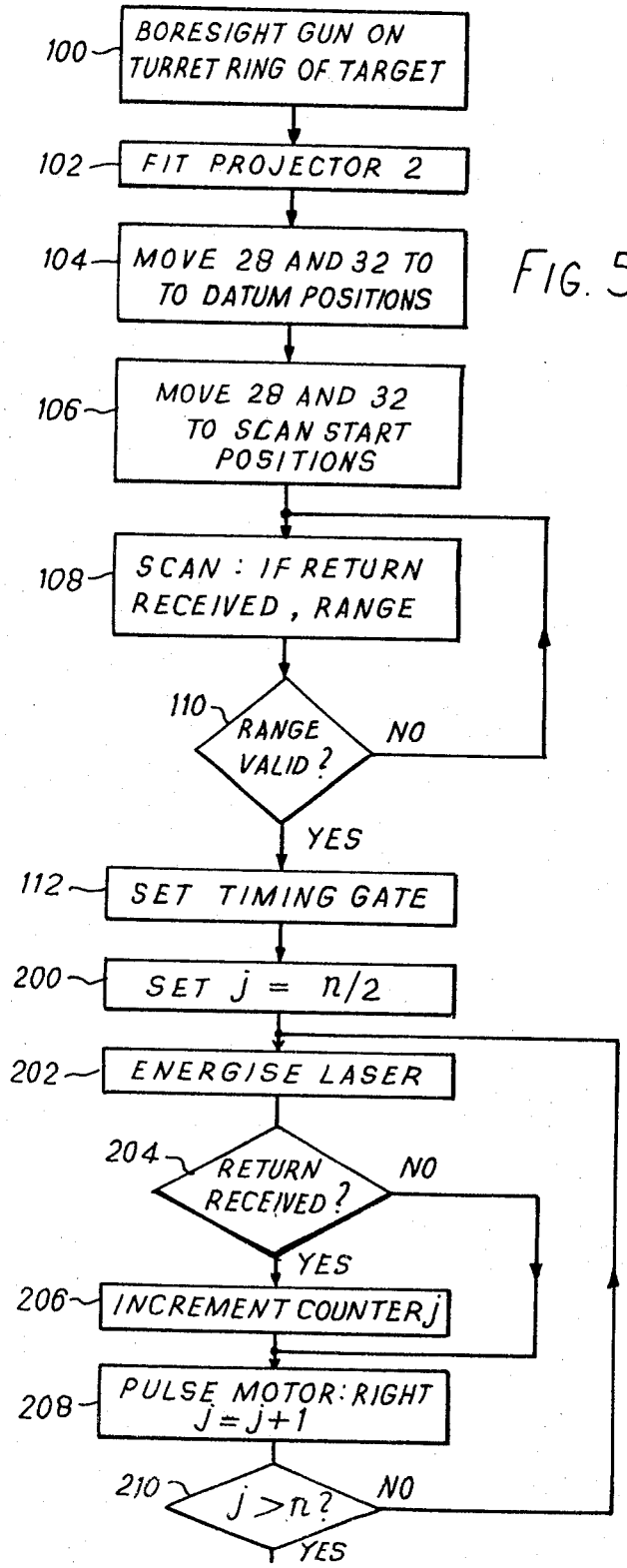
Figure 5B:
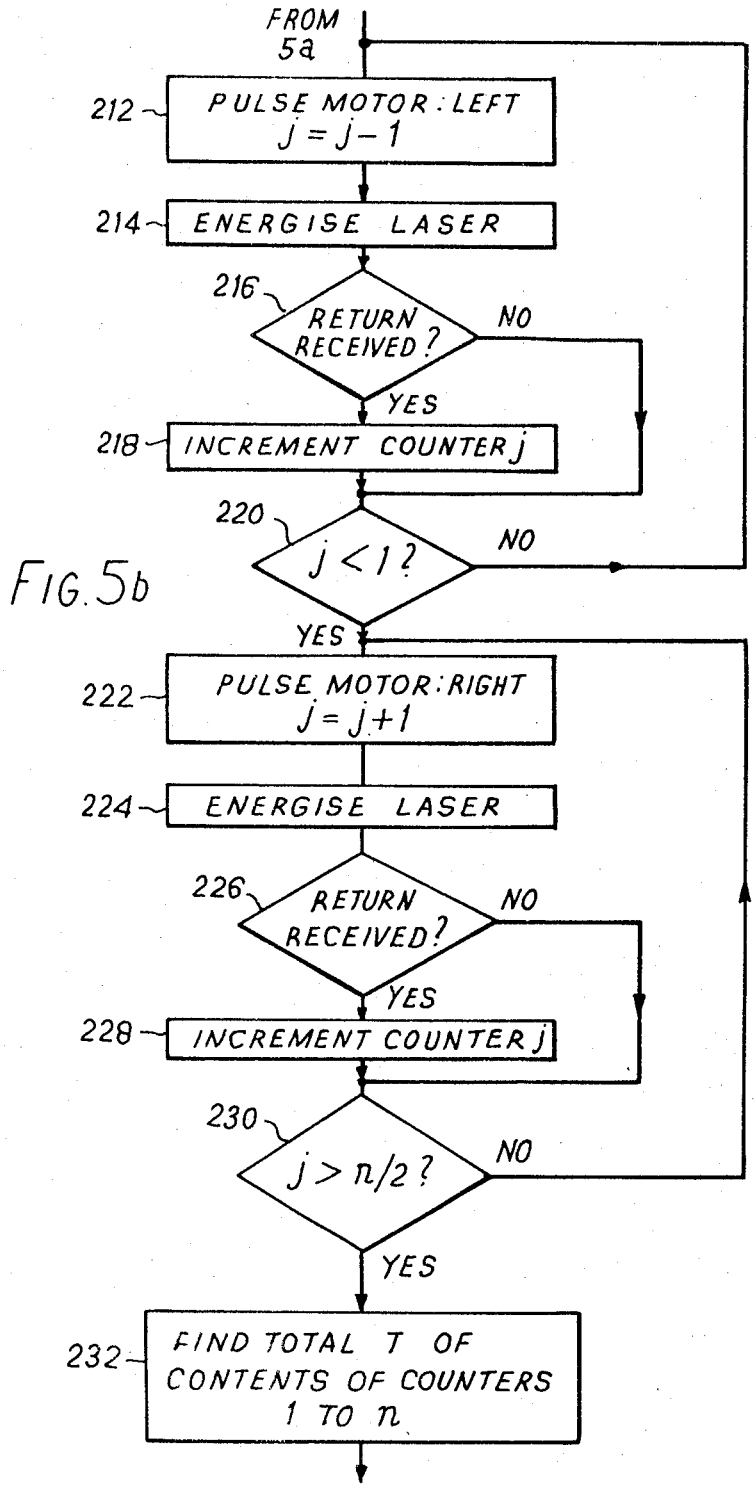
Figure 5C:
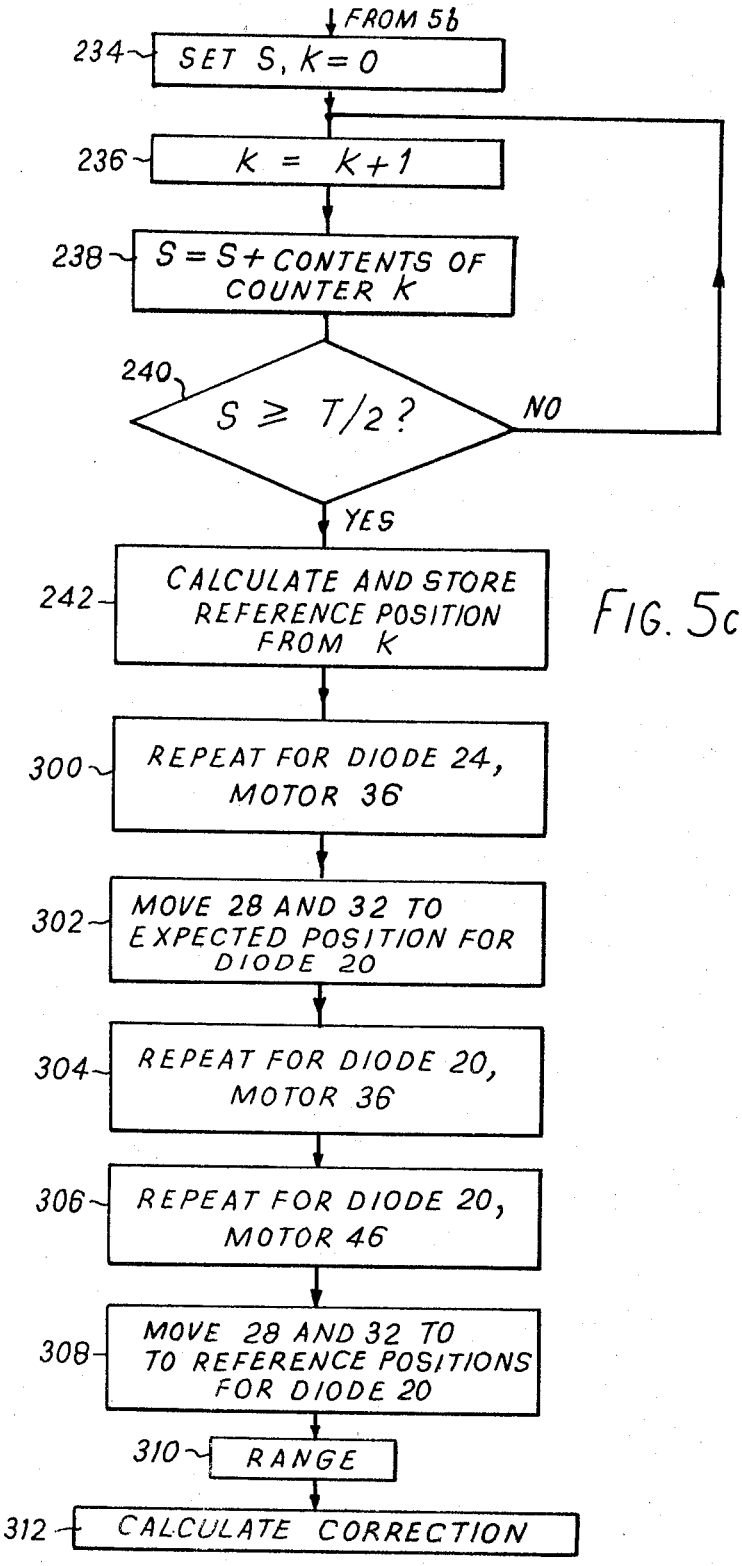

FIGS. 5*a*–5*c* show a flow chart depicting the operation of the apparatus of FIG. 4; and FIGS. 6, 7, and 8 are diagrams illustrating patterns scanned during the operation depicted in FIG. 5.

Figure 1:
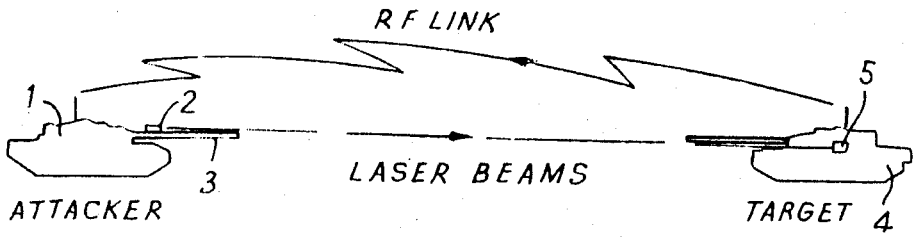
FIG. 1 depicts an attacking tank and a target tank.

The methods and apparatus to be described are for use in equipment for training tank crews in gunnery and firing procedures without the expense and danger of firing live ammunition. As shown in FIG. 1, an attacking tank 1, with a projector 2 mounted on a main gun 3, is engaging a target tank tank 4 carrying a detector 5. Simulated firing of the main gun 3 causes a pulsed beam or beams of radiation from a laser source within the projector 2 to scan in relation to the axis of the main gun 3, to detect a 'hit' or a 'miss'. When a beam impinges on the detector 5, a signal is transmitted by an r.f. transmitter in the target tank 4 to a receiver in the attacking tank 1.

Figure 2:
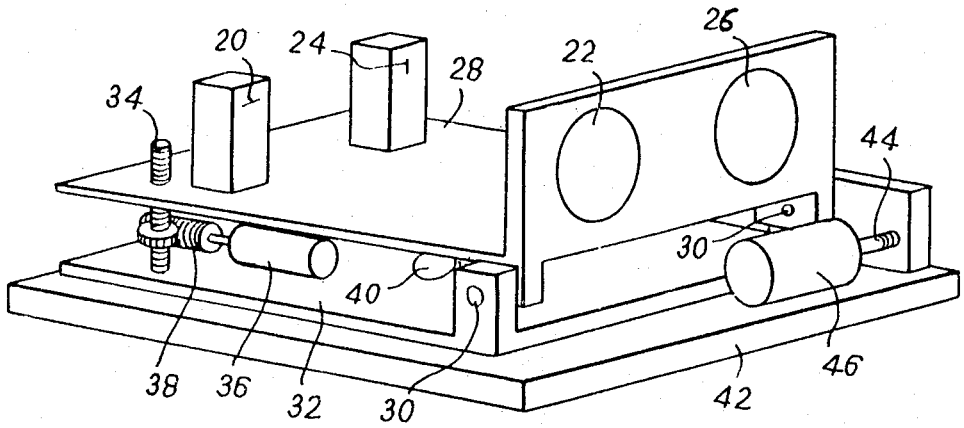
FIG. 2 shows diagrammatically a source of two beams of radiation and means for steering these beams.

The positioning and scanning relative to the main gun 3 of the laser beam or beams can be effected by steering the beams in azimuth and in elevation, and an arrangement for accomplishing this is shown diagrammatically in FIG. 2.

Referring to FIG. 2, a first beam, narrow in elevation, is formed by a gallium-arsenide (GaAs) laser diode 20, mounted with its junction lying in the horizontal plane, and a collimating lens 22. A second beam, narrow in azimuth, is formed by a GaAs laser diode 24, mounted with its junction lying in the vertical plane, and a collimating lens 26.

Lasers 20 and 24 and lenses 22 and 26 are mounted on a common frame 28 which is pivotable about an axis 30 in relation to a subframe 32. A screw 34 is screw-threadedly engaged in the frame 28, and is free to rotate in, but not to move axially with respect to, the subframe 32. The frame 28 may be tilted about the axis 30 with respect to the subframe 32, by operation of a geared electric motor 36 which drives the screw 34 through a worm gear 38.

The subframe 32 may also be rotated about a bearing 40 with respect to a base 42, by means of a screw 44 engaged in a screwed hole in the subframe 32 and driven by a geared electric motor 46. The base 42 is, in operation, positively located with respect to the boresight of the main gun 3 on the attacking tank 1. The geared electric motors 36 and 46 are stepping motors provided with control circuits (for example, as described in British Patent Specification No. 1,298,332) which enable the number of steps or revolutions of the motors, and therefore the angular position of the frame 28 about the axis 30 and of the subframe 32 about the bearing 40, to be expressed in terms of the number of pulses of energising current supplied to the motors 36 and 46 to move them from respective datum or zero positions.

Full details of the circuitry and operation of a weapon training system such as that shown in FIG. 1 are contained in our British Patent Specifications Nos. 1,228,143, 1,228,144 and 1,451,192.

Figure 3:
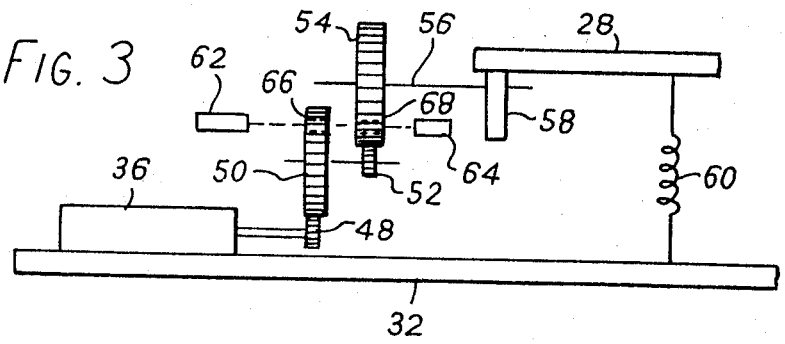
FIG. 3 shows diagrammatically an alternative means for steering the source shown in FIG. 2.

Instead of coupling the stepping motors 36 and 46 to the frame 28 and the subframe 32 through screws (34 and 44), it is possible to use cams, as shown schematically in FIG. 3. FIG. 3 also shows a method of detecting when the motors 36 and 46 (and the frame 28 and the subframe 32) are in a datum position.

Referring to FIG. 3, which for convenience shows only the arrangement for moving the frame 28, the motor 36 drives a reduction gear train comprising, successively, a pinion 48 on the shaft of the motor 36, a gear wheel 50, a second pinion 52, and a second gear wheel 54. A shaft 56 carrying this second gear wheel 54 also carries a cam 58, and the frame 28 is urged against the cam 58 by a spring 60. Appropriate choice of the number of energising pulses supplied to the stepping motor 36 enables the cam to be turned to any desired angular position, and thus the frame 28 to be positioned as required about the axis 30.

A light-emitting diode 62 is located on one side of the gear train, opposite a photo-sensitive cell 64 on the other side. The gear wheels 50 and 54 are provided with holes 66 and 68 respectively, near their circumferences, at appropriate angular positions such that, when the surface of the cam 58 abutting the frame 28 is at its lowest position, the light-emitting diode 62, the photo-cell 64 and the holes 66 and 68 are in line. Thus, in this situation, the photo-cell 64 will be irradiated by the light-emitting diode 62, and will supply a signal indicative that the cam 58 is in its datum or zero position. Operation of the stepping motors 36 and 46 typically requires the supply of successive differently coded signals to the motor windings. Logic circuitry (not shown) can be arranged to detect coincidence of a particular coded signal with the output from the photo-cell 64 to provide a precise, unambiguous indication that the cam 58 is in the datum position.

Referring now to FIG. 4, there is shown in schematic form the circuitry for detecting and storing the positions of the frame 28 and the subframe 32 (that is, the numbers of energising pulses required for the stepping motors 36 and 46 to drive their respective cams 58 from their datum positions to the corresponding angular positions) in which the orientations of the beams generated by the laser diodes 20 and 24 are in line with the bore of the main gun 3.

The operation of the circuitry is coordinated by a sequence controller 70 which is coupled to a scan controller 72, a drive circuit 74, a range circuit 76 and a counter stack 78. The scan controller 72 includes the circuitry required to supply appropriate energising pulses to the stepping motors 36 and 46, and the drive circuit 74 controls energisation of the laser diodes 20 and 24. The range circuit 76 derives the range of a target by measuring the elapsed time between emission of a laser pulse and receipt of the corresponding r.f. signal from the target (see FIG. 1). Further details of these circuits can be found in the above-mentioned Patent Specifications.

FIG. 5 indicates in flowpath form the operation of the circuitry of FIG. 4.

Referring now to FIG. 5, the gun 3 is first boresighted on the turret ring of a target tank 4 at step 100, and then the projector 2 is mounted on (or alternatively in) the gun 3, at step 102. The alignment procedure of the system is then activated, whereupon the sequence controller 70 causes the scan controller 72 to energise the stepping motors 36 and 46 and return the frame 28 and the subframe 32 to their datum positions (step 104).

At step 106, the stepping motors 36 and 46 are moved to predetermined positions so that the beam orientation for the laser diode 24 is within a specified 'search' area smaller than the overall area over which the laser beams can be scanned (this ensures that the system is eventually aligned with the beam orientation somewhere near the centre of this overall area).

Starting in one corner of the search area (see FIG. 6), the sequence controller 70 at step 108 causes the beam from the laser diode 24 to be scanned across the search area on the path shown in FIG. 6. After each pulse has been supplied to the stepping motor 46 (which causes movements in azimuth of the laser beams), the laser diode 24 is energised. When a return is received via the r.f. link (FIG. 1), indicating that the laser beam is incident on the detector 5, the laser diode 24 is energised up to 40 times at that position, while the range circuit 76 measures the range as described earlier. If 5 equal range measurements result, as detected at step 10 the procedure advances to step 112. Otherwise, the procedure returns to step 108 for further scanning and energisation of the laser beam from the laser diode 24.

When a valid range has been detected (at step 110), the sequence controller 70 operates a timing gate in the range circuit 76, at step 112, to restrict the receipt of r.f. signals to those occurring at times close to that corresponding to the measured range.

The sequence controller 70 now commences a procedure, starting at step 200, to find the orientation of the laser beam for which the beam is directed exactly at the detector 5.

At step 200, the controller 70 sets a variable j equal to n/2, where n is the number of energising pulses required for the laser beam to traverse the desired angle while searching for the exact location of the target. It will be noted that the frame 28 is still in the position at which a valid range was found at step 110. Starting at this position, the laser diode 24 is energised (step 202) and the presence or absence of an r.f. return signal tested at step 204. If there is no return, the procedure jumps to step 208, but if there is a return, a counter j in the counter stack 78 is incremented by 1 at step 206.

The stepping motor 46 is now pulsed once to move the laser beam orientation one step to the right (see FIG. 7), and the variable j is incremented by 1, at step 208. Provided that j is not found to exceed w, at step 210, the procedure returns to step 202 to energise the laser diode 24 again, and store the receipt, if any, of an r.f. return signal.

When j is found to exceed n at step 210, the procedure advances to step 212, where the stepping motor 46 is pulsed to move the laser beam orientation back one step to the left, while the variable j is decremented by 1. The procedure now cycles through steps 214, 216, 218, 220 and 212, testing for an r.f. return signal at each position of the stepping motor 46, until step 220 determines that j is less than 1. It will be noted that steps 214, 216 and 218 are counterparts of the steps 202, 204 and 206 described earlier.

When j is found to be less than 1, the procedure advances to step 222, where the stepping motor 46 is pulsed to move the laser beam orientation to the right again, and j is once more incremented by 1 again. The procedure now effectively repeats steps 202 to 210, at steps 222 to 230, until j is found, at step 230, to exceed n/2 again.

At this point, the laser beam from the diode 24 will have traversed the path shown in FIG. 7, and the presence or absence of an r.f. return signal tested and recorded in total twice at each position within the traverse.

Although the presence of an r.f. return signal should be indicative that the laser beam is incident on the detector 5, it is also possible for radio interference to give rise to spurious r.f. return signals (that is, when the laser beam is not oriented towards the target 4) and for atmospheric scintillation to inhibit genuine return signals. In order to determine an accurate orientation for the laser beam despite such spurious and missing signals, the procedure now advances to step 232.

At step 232, the contents of all the counters (j=1 to n) in the stack 78 are totalled in an analyser 80 (FIG. 4) to derive a total T. Then, at step 234, the value of a parameter S and of a variable k are set to 0. k is then incremented by 1, at step 236, and the contents of the counter k added to the parameter S, at step 238. Steps 236 and 238 are repeated until S is found, at step 240, to have attained a value equal (or just greater than) T/2. The value of k at this point is then taken as being the value for which the beam from the laser diode 24 is exactly oriented towards the detector 5.

The corresponding position for the stepping motor 46 can then be calculated at step 242 from the known position of the motor 46 and the corresponding value of j (for example, at step 230) and the value of k found at step 240.

This first reference position of the stepping motor 46 is stored.

With the stepping motor 46 in this position, the procedure of steps 200 to 242 is repeated at step 300 for the laser diode 24, but this time energising the stepping motor 36 to scan the laser beam vertically (FIG. 8).

When the first reference position of the stepping motor 36 has thus been found and stored, the motor 36 is set at this position, and, at step 302, the motor 46 is energised by a predetermined number of pulses (related to the spacing of the laser diodes 20 and 24) to bring it to a position expected to direct the beam of the laser diode 20 at the detector 5. The procedure of steps 200 to 242 is now used twice more to find, at steps 304 and 306, the reference positions for the stepping motors 36 and 46 in respect of the beam from the laser diode 20.

The stepping motors 36 and 46 are then set (at step 308) to the reference positions found at steps 304 and 306, and, at step 310 the range of the target 4 is found once more. From this value, and the known vertical spacing between the detector 5 and the turret ring of the tank 4, a correction factor is calculated at step 312 to take account of the fact that although the gun 3 is boresighted on the turret ring of the tank 4, the projector 2 must be aimed at the detector 5 to secure an r.f. return signal. This correction factor can then be applied as appropriate to the two reference positions found for the stepping motor 36.

During subsequent operation of the weapon training system, the laser beams from the projector 2 can be brought into line with the gun 3 whenever desired, merely by stepping the motors 36 and 46 to the appropriate stored reference positions.

Furthermore, in simulation of a battle engagement, the procedure of steps 200 to 242 can be used, slightly modified if necessary, to find the position of the target tank 4 relative to the beam datum direction during scanning to determine whether a 'hit' has been achieved (by comparing the values for k in elevation and azimuth, found at step 242, with the stepping motor positions for the beam datum direction).

It is also envisaged that the procedure of steps 200 to 242 could be of value in sensing the presence and direction of a remotely-generated beam of radiation incident upon a directional photo-detector carried by the frame 28 in place of the laser diodes 20 and 24.

Although the apparatus shown in FIG. 4 has been depicted in block diagram form, the functions shown in FIG. 5 may equally be implemented in an appropriately-programmed digital computer.

The steps 200 to 242 may be modified in the case of detection at long ranges by repeating the scan patterns shown in FIGS. 7 and 8 several times before the steps 232 to 242 are carried out.

Although the system described above has the detector 5 mounted on the target 4, as shown in FIG. 1, it is to be understood that the invention is equally applicable to systems in which the detector 5 is carried with the projector 2 by the attacker 1, radiation incident upon the target 4 being returned to the detector 5 by a retro-reflector carried by the target 4. Furthermore, depending on the particular design of the projector 2, the scanning of the laser beams might involve movement of only part of the laser source rather than of the source in its entirety as described above.

I claim:

1. A method for the alignment of weapon training system comprising the steps of:

sighting a weapon, having associated therewith source means for providing a beam of electromagnetic radiation, at means for enabling incidence of a beam thereupon to be detected;

scanning said source means through a plurality of beam orientations relative to said weapon;

energising said source means for each orientation and storing an indication of each orientation in which incidence of the beam is detected; and deriving from said indications the beam orientation in which the system is aligned with the weapon.

2. A method according to claim 1, wherein said source means is energised a plurality of times for each said beam orientation, and the number of times incidence of the beam is detected for each said beam orientation is stored.

3. A method according to claim 2, wherein the beam orientation in which the system is aligned with the weapon is selected as the one for which substantially equal numbers of indications of incidence of the beam exist for orientations each side of the selected orientation.

4. A method according to claim 1, wherein the procedure is effected for two orthogonal scanning directions.

5. A method according to claim 1, wherein said detection-enabling means comprises means for detecting incidence of a beam thereupon.

6. A weapon training system comprising:

source means associated with a weapon for providing a beam of electromagnetic radiation;

means for enabling incidence of said beam thereupon to be detected;

means for scanning said source means through a plurality of beam orientations relative to said weapon when said weapon has been sighted on said detection-enabling means;

means for energising said source means for each said orientation;

means for storing an indication of each orientation in which incidence of the beam is detected; and means for deriving from said indications the beam orientation in which the system is aligned with the weapon.

7. A system according to claim 6, wherein the energising means is arranged to energise the source means a plurality of times for each said beam orientation, the storing means then storing the number of times incidence of the beam is detected for each said beam orientation.

8. A system according to claim 7, wherein the deriving means is arranged to select the beam orientation for which substantially equal numbers of indications of incidence of the beam exist for orientations each side of the selected orientation.

9. A system according to claim 6, wherein said detection-enabling means comprising means for detecting incidence of a beam thereupon.

* * * * *